United States Patent [19]
Yarnell

[11] 4,026,987
[45] May 31, 1977

[54] RECOVERY OF URANIUM SULFATE ANIONS ON A WEAK BASE ANION EXCHANGE RESIN

[75] Inventor: Peter A. Yarnell, Andalusia, Pa.

[73] Assignee: Rohm and Haas Company, Philadelphia, Pa.

[22] Filed: Oct. 11, 1974

[21] Appl. No.: 513,979

[52] U.S. Cl. ..... 423/7; 210/37 B
[51] Int. Cl.[2] ..... C01G 43/00
[58] Field of Search ..... 423/6, 7; 210/37

[56] References Cited

UNITED STATES PATENTS

| | | | |
|---|---|---|---|
| 2,795,480 | 6/1957 | Stephan et al. | 423/7 |
| 2,914,378 | 11/1959 | Kennedy | 423/7 X |
| 3,743,695 | 7/1973 | George et al. | 423/7 X |
| 3,773,889 | 11/1973 | George et al. | 423/7 X |
| 3,784,489 | 1/1974 | Dales et al. | 260/2.1 C |
| 3,835,044 | 9/1974 | Schulz | 423/7 X |

*Primary Examiner*—Edward A. Miller

[57] ABSTRACT

A process for recovering uranium as an anionic sulfate complex from sulfuric acid leach liquors is disclosed and claimed. A novel weak base anion exchange resin is used in this process.

13 Claims, No Drawings

RECOVERY OF URANIUM SULFATE ANIONS ON A WEAK BASE ANION EXCHANGE RESIN

It is known in the art to recover uranium from sulfuric acid leach liquor by adsorption of the uranium as an anionic sulfate complex on quarternary or tertiary amine anion exchange resins. Prior art processes have, however, been severely limited in the following regards. First, the resins used in these processes are of low capacity, resulting in short running times and consequent inefficiency of operation. Low capacity has necessitated frequent regeneration which requires large amounts of manpower or expensive means of automation. Frequent regeneration also results in the formation of large quantities of dilute rinse waters which are difficult to dispose of. In addition, large expensive resin inventories are required. Secondly, the prior art processes have been using resins which are too light in density and which have thus a tendency to float in the thick ore slurries or pulps. This has severely limited the ability to treat ore slurries or pulps in an upflow manner, the most efficient means of operation.

The new and novel process of the present invention overcomes the deficiencies of the prior art. In this process, the acid leach solution or a slurry of finely divided ore in dilute sulfuric acid containing uranyl sulfate complex is passed (downflow or upflow) through a bed of anion exchange resin produced by (a) condensing polyethyleneimine with a dihaloalkane and (b) then subjecting the resin to reductive alkylation with formaldehyde and formic acid, all as shown in U.S. Pat. No. 3,784,489 (see especially column 2, lines 34 to 58, and Example 6 in column 4 thereof). While the weak base resin is the preferred form, one may also use strong base resins prepared according to the teachings of U.S. Pat. No. 3,784,489 (see Example 7 thereof).

In the preferred embodiment of the invention, the leach solution is passed through the ion exchange bed or bed of resin in an upflow manner. In the novel process of the present invention, a very large number of bed volumes of uranyl sulfate complex solution can be treated with substantially no leakage, at least twice those treated in any process of the prior art. After the resin is loaded with uranyl sulfate complex, the uranium is eluted using a new elution system developed specifically for this resin. Uranium (in salt form) is efficiently removed from the resin, and resin may then be reused.

An important aspect of the present process is that the specific resin used is sufficiently dense that it may be operated efficiently upflow, even with slurries of finely divided ore. This allows the treatment of more dense ore slurries than prior art processes and at substantially more rapid flow rates. Because of the more rapid flow rates, much less resin inventory is required for the process.

In the examples noted below and throughout the specification and claims, all parts and percentages are by weight, unless otherwise noted.

EXAMPLE 1

This example utilizes a procedure for testing uranium removal form acid leach liquors, said procedure having been adopted from a commercial process.

The polyethyleneimine-ethylene dichloride, weak base condensate anion exchange resin (referred to hereinafter as Resin A), as received from plant production, is wet screened and adjusted to the following mesh cut distribution:

| U.S. Sieve | |
|---|---|
| +16 | 0.03 ml. |
| −16 +20 | 0.06 ml. |
| −20 +30 | 5.65 ml. |
| −30 +40 | 15.18 ml. |
| −40 +50 | 3.85 ml. |
| −50 +325 | 0.23 ml. |
| | 25.00 ml. |

This allows a direct comparison with prior resins tested by eliminating particle size effects. Approximately 25 ml. of the resin is conditioned with 1 liter of 4% hydrochloric acid for 30–45 minutes. After conditioning with the acid, the 25 ml. of resin is reduced to 20 ml. of resin in volume. The resin is then rinsed with 1 liter of deionized water for 30–45 minutes. The resin is tapped into a jacketed burette column.

Loading

A synthetic clarified uranium leach liquor is made by adding 32 grams of uranyl sulfate and 72 grams of concentrated sulfuric acid and diluting to 16 liters with deionized water. The uranium concentration is checked spectrophotometrically according to standard Laboratory 10 procedure. The leach liquor contains 1.30 ± 0.05 g. $U_3O_8$/liter resin (in the uranyl sulfate form).

A pump is used to load column downflow with this leach liquor at rate of 160 ml./hour. Each bed volume (BV) of column effluent is collected separately and automatically in test tubes on a turntable. Thus, individual fractions can be analyzed for $U_3O_8$ content. A 5% $U_3O_8$ breakthrough is considered the standard endpoint. A 10% solution (12.1 grams/90 ml. of $H_2O$) of $K_3Fe(CN)_6 \cdot 3H_2O$ is used as an indicator.

With Resin A, i.e., the polyethyleneimine-ethylene dichloride condensate weak base anion exchange resin, the Resin A being the resin of choice used in the present invention, 5% leakage occurs at roughly 80 BV throughput. This represents double to triple the throughput volume normally encountered with weak base resins (see Table I). Approximately 275 BV are required before 100% leakage of $U_3O_8$ occurs.

The total uranium capacity on loading varies from 130.8–147.8 g. $U_3O_8$/1. (see Table II); this variation is attributed to resin regeneration efficiency. All these capacities are at least double those of other weak base resins.

TABLE I*

| Sample Resin** | Uranium Capacity (g. $U_3O_8$/l.) | Loading Breakthrough (BV) | E.V.R. | E. C. (g. $U_3O_8$/l.) |
|---|---|---|---|---|
| G | 41.0 | 23.0 | 6.85 | 5.99 |
| F | 49.4 | 32.5 | 6.00 | 8.20 |
| E | 56.1 | 25.0 | 6.50 | 8.63 |
| D | 56.3 | 29.2 | 6.00 | 9.40 |
| C | 63.1 | 30.0 | 11.8 | 5.36 |
| B | 66.6 | 34.7 | 8.00 | 8.30 |
| A | 144.4 | ~80 | 13.7 | 10.5 |

*Typical values under normal elution conditions
**(See page 42)

Resin A

This resin is defined hereinabove in the second paragraph of Example 1. In more detail, Resin A is a polye- :hyleneimine-ethylene dichloride, weak base condensate anion exchange resin prepared according to the teachings of U.S. Pat. No. 3,784,489 (see especially Example 6 thereof).

Resin B

A styrene-DVB* (about 6% DVB) macroreticular weak base resin with a dimethylbenzyl amine functionality.

*DVB = divinylbenzene

Resin C

A styrene-DVB (5% DVB) macroreticular weak base resin having tertiary amine sites or functionality.

Resin D

An unoxidized intermediate macroreticular weak base resin based on styrene-DVB (6% DVB) having tertiary amine sites or functionality.

Resin E

A macroreticular weak base resin (styrene/3% DVB/4% trimethylolpropanetrimethacrylate) with a partial conversion of the weak base tertiary amine sites to the amine oxide form.

Resin F

A small size mesh cut (−25 +50) of Resin C.

Resin G

A dense macroreticular weak base resin (specific gravity ≥ 1.06) based on styrene-DVB (6% DVB) with amine oxide functionality.

In the resins above, the styrene or ethylvinylbenzene (from the DVB) constitutes the balance of the matrix of the resin.

TABLE II

| Trial | Uranium Capacity (g. $U_3O_8$/l.) | Elution Medium and Conditions | E.V.R. | E.C. (g. $U_3O_8$/l.) |
|---|---|---|---|---|
| 1 | 133.7 | 2M NaCl | 19.3 | 6.93 |
| 2 | 130.8 | 2M NaCl | 20.7 | 6.32 |
| 3 | 135.9 | 0.9M $NH_4NO_3$/0.1N $HNO_3$ | 21.0 | 6.47 |
| 4+ | >103.5 | 1.8M $Na_2SO_4$/0.2N $H_2SO_4$ at 50° C. | 32.5 | >3.19 |
| 5 | 146.0 | 4M NaCl | 27.5 | 5.31 |
| 6 | 144.4 | 3.6M NaCl/0.4N HCl at 50° C. | 13.7 | 10.5 |
| 7 | 147.8 | 3.6M NaCl/0.4N HCl | 20.0 | 7.39 |

+No. 4 terminated due to time.

Elution

After loading is completed, the resin is washed with 1 BV of deionized water to displace any uranium solution remaining. A salt solution is used to elute the $U_3O_8$* from the resin. This solution is gravity fed downflow to the column at a rate of 40 ml./hour. The first ½ BV of effluent is discarded. Further effluent cuts are caught in volumetric flasks (10 or 25 ml.) and diluted to a volume at which the uranium concentration can be determined spectrophotometrically using 415 A visible light. Downflow elution is continued until a 5% leakage endpoint is achieved.

*While the uranium capacity (in both loading and elution) is expressed in terms of $U_3O_8$, it (the resin) is loaded and eluted in the form of a complex salt.

While the uranium capacity (in both loading and elution) is expressed in terms of $U_3O_8$, it (the resin) is loaded and eluted in the form of a complex salt.

As noted in Table II, the EVR (elution to volume ratio), (= elution volume ÷ resin volume) is as low as 13.7 BV. The average elution concentration, EC (the average concentration of $U_3O_8$ in the total volume of eluant) is as high as 10.5 g. $U_3O_8$ per liter of solution or eluant. The eluted uranium capacity of the resin is the product of the EC and the EVR.

$$U_3O_8 \text{ Capacity} = EC \times EVR$$

Ideally, the capacity and EC are maximized, while the EVR is minimized. Experimentally, the best results are achieved using 3.6M NaCl/0.4N HCl to elute the resin at a temperature of 50° C. (see Table II). Obviously, all three conditions of concentration, acidification, and heat are necessary for good elution. Sodium chloride is the preferred salt due to economics. Elevated resin temperature is controlled by passing heated water (50° ± 3° C.) through the jacketed burette column surrounding the resin. In the present invention, 85–90% (capacity of 120–125 g. $U_3O_8$/l.) of the uranium is eluted in roughly 7 BV — a figure comparable to or better than current weak base resins. Even this reduced capacity is roughly double that of standard resins.

Density

The true wet density is measured using a pyknometer at 25° C. The resin is treated with 1 liter of 4% $H_2SO_4$ for 30–45 minutes, rinsed with 1 liter of deionized water for 30–45 minutes, and Buchner drained. A sample of a typical styrene/DVB was tested concurrently with the polyethyleneimine-ethylene dichloride condensate resin (Resin A) used in the present invention. The results were:

| Sample | Density (g./ml.) |
|---|---|
| Resin D | 1.092 |
| Resin A | 1.207 |

The high density of Resin A in the sulfate form (the one encountered in uranium leach liquors) makes it ideal for upflow or downflow operation. A further indication of this is obtained by determining hydraulic expansion.

Hydraulic Expansion

To determine hydraulic expansion, the resin is conditioned as for density and screened to −20 +30 mesh cut. The resin is loaded into a column of known inner diameter (ID), backwashed, and drained. Then a sodium sulfate solution of specific gravity 1.02 (simulating uranium leach liquor) is used to backwash the resin bed to 200% expansion. The necessary flow rates for Resin D and Resin A respectively are:

| Sample | Hydraulic Expanson (U.S. gal./ft.²/min.) |
|---|---|
| Resin D | 6.79 |
| Resin A | 12.5 |

The higher flow rate (nearly double that of Resin D) available with Resin A makes it very attractive for uranium recovery in a continuous counterflow contactor.

While removal of the uranium complex salt is generally carried out in an upflow manner and the regeneration or elution in a downflow manner, it is still within the scope of the present invention to carry out either operation (loading or elution) in an upflow or downflow manner.

EXAMPLE 2

Since the synthetic clarified leach liquor used in Example 1 had a specfic gravity of only 1.003 g./ml., 20.0 g./l. of anhydrous $Na_2SO_4$ has been added to it to attain a specific gravity of 1.02 g./ml. while retaining a pH of 1.8 at ambient temperatures (~24.5° C.). The resultant leach liquor contains 1.278 g. $U_3O_8$/l. resin.

The leach liquor is loaded upflow on Resin A (Resin A having been defined hereinabove in the second paragraph of Example 1, i.e., the polyethyleneimineethylene dichloride, weak base condensate anion exchange resin having been prepared according to the teachings of U.S. Pat. No. 3,784,489 [see Example 6 thereof]) at the flow rate of 1 gpm/ft.$^3$; this rate should simulate that to be used by the uranium industry. Otherwise, the loading conditions are identical to those in Example 1. The only change noted from prior trials is that the resin quantity after loading was reduced to 18 ml. (from 20 ml.). Several explanations for this phenomena are possible: (1) resin breakage with upflow removal of fines, (2) resin breakage with resultant compaction of the bed, or (3) resin shrinkage due to change in ionic form. The loading effluent was screened for fines with none observed. The resin was looked at microscopically to check for fragments; none were seen. The resin was rescreened and reconverted to its original ionic form; the original volume returned. We conclude the resin shrank during the upflow loading. Since no similar volume change has been observed previously, this shrinkage can presumably be attributed to the presence of $Na_2SO_4$ in the leach liquor.

The downflow elution procedure is identical to that used in Example 1. The elution medium used is the 3.6M NaCl/0.4N HCl with the resin at 50° C. The elution endpoint (5% of loading concentration) of 13.75 BV (=EVR) is identical to that obtained with the same resin using downflow loading. The resin volume is assumed to be 20 ml. as in prior experiments. The average elution concentration, EC, is 9.21 g. $U_3O_8$/l.; thus, the uranium capacity is 126.6 g. $U_3O_8$/l. Using the resin volume of 18 ml., the uranium removal capacity rises to 140.4 g. $U_3O_8$/l. with a concomitant rise in the EVR. This value compares very favorably with previous uranium capacities. Even the lower capacity figure is double the value of current weak base resins. As was previously the case, 85–95% of the uranium capacity is achieved in only 7 BV — an acceptable number commercially.

I claim:

1. In the method of recovering uranium from sulfuric acid leach liquor by adsorption of the uranium as an anionic sulfate complex on an amine anion exchange resin, the improvement which comprises using as the resin a dense weak base, anionic exchange resin, said resin having tertiary amine groups and said resin being the condensation product of polyethyleneimine and ethylene dichloride and wherein thereafter the resin is subjected to reductive methylation with formaldehyde and formic acid.

2. Process according to claim 1 wherein the resin is regenerated with a salt solution elutant or elution medium.

3. Process according to claim 1 wherein the resin is regenerated with a salt solution elutant or elution medium.

4. Process according to claim 1 wherein the regeneration or elution medium contains a minor account of an acid.

5. Process according to claim 1 wherein the regeneration or elution medium contains a minor amount of an acid.

6. Process according to claim 4 wherein the acid is HCl.

7. Process according to claim 5 wherein the acid is HCl.

8. Process according to claim 1 wherein the loading of the resin is carried out in a downflow manner in a suitable container.

9. Process according to claim 1 wherein the loading of the resin is carried out in a downflow manner in a suitable container.

10. Process according to claim 1 wherein the elution is carried out at an elevated temperature.

11. Process according to claim 1 wherein the elution is carried out at 50° C. or at a higher temperature.

12. Process according to claim 1 wherein the loading of the resin is carried out in an upflow manner in a suitable container.

13. Process according to claim 1 wherein the loading of the resin is carried out in an upflow manner in a suitable container.

* * * * *